US010477966B2

(12) United States Patent
Partington et al.

(10) Patent No.: US 10,477,966 B2
(45) Date of Patent: Nov. 19, 2019

(54) SYSTEM FOR OPTIMIZING USE OF STORAGE SPACE

(71) Applicants: Matthew Joseph Partington, West St. Paul, MN (US); Patricia Jean Partington, West St. Paul, MN (US)

(72) Inventors: Matthew Joseph Partington, West St. Paul, MN (US); Patricia Jean Partington, West St. Paul, MN (US)

( * ) Notice: Subject to any disclaimer, the term of this patent is extended or adjusted under 35 U.S.C. 154(b) by 0 days.

(21) Appl. No.: 15/426,014

(22) Filed: Feb. 6, 2017

(65) Prior Publication Data

US 2017/0224111 A1 Aug. 10, 2017

Related U.S. Application Data

(60) Provisional application No. 62/292,066, filed on Feb. 5, 2016.

(51) Int. Cl.
*A47B 88/975* (2017.01)

(52) U.S. Cl.
CPC ..... *A47B 88/975* (2017.01)

(58) Field of Classification Search
CPC ..... A47B 88/975; A47B 96/04; A47B 88/00; A47B 88/969; A47B 88/931; B42F 15/0094
USPC ..... 211/184
See application file for complete search history.

(56) References Cited

U.S. PATENT DOCUMENTS 1,285,890 A * 11/1918 Anderson ..... G09F 1/10 40/312
1,309,965 A * 7/1919 Schwab ..... A47K 5/02 108/47
1,330,684 A * 2/1920 Chwala ..... G09F 3/18 40/652
1,540,394 A * 6/1925 Hall ..... A47J 43/287 248/231.81

(Continued)

*Primary Examiner* — Ko H Chan
(74) *Attorney, Agent, or Firm* — Craig J. Lervick; Larkin Hoffman Daly & Lindgren, Ltd.

(57) ABSTRACT

This Product will add or create storage space in a pull-out sliding drawer and provide support to prevent additional material from falling off/out of a pull-out sliding drawer. The user will be able to securely store additional material in a pull-out sliding drawer than anticipated. Pull-out sliding drawers common in several cabinets provide a certain amount of area in which to store material, which can be defined by the area within the height of the drawer side (walls or dividers) of a pull-out sliding drawer and the amount of space above a pull-out sliding drawer and below the cabinet or drawer above. In some cases, the height of the drawer wall or divider (which can hold material in the drawer) does not allow for adequate use of the overall area provided to store material due to the walls or dividers not being high enough to store and hold material in. The area above a pull-out sliding drawer and below the cabinet or drawer above is defined as "potential storage area." This product can be easily placed on and removed, from the top of the walls/dividers of a pull-out sliding drawer. Once in place, it will provide additional height and support for material stored. As a result of this product, the total "potential storage area" in a drawer to store material is more efficiently utilized.

18 Claims, 12 Drawing Sheets

(56) References Cited

U.S. PATENT DOCUMENTS 1,770,836 A * 7/1930 Boote ..... B42F 15/0035 312/348.3
2,779,114 A * 1/1957 Orthwine ..... G09F 1/10 273/150
2,865,588 A * 12/1958 McCartney ..... B60Q 7/005 248/231.81
3,164,126 A * 1/1965 Matel ..... B65G 47/493 24/557
3,881,713 A * 5/1975 Joyce ..... A47C 3/0252 248/624
4,044,485 A * 8/1977 Hopp ..... G09F 3/16 40/324
4,219,247 A * 8/1980 Litchfield ..... A47B 88/00 211/46
4,765,490 A * 8/1988 Hanson ..... B24F 15/0094 211/175
4,794,876 A * 1/1989 Levine ..... B63B 7/04 114/352
5,353,714 A * 10/1994 Hardy ..... A47B 57/58 108/108
6,039,422 A 3/2000 Butters et al.
6,435,359 B1 * 8/2002 Priminano ..... A47F 7/28 211/75
6,550,874 B2 * 4/2003 Walla ..... A47B 96/06 312/184
7,631,771 B2 12/2009 Nagel et al.
7,874,088 B2 * 1/2011 Nikols ..... G09F 3/08 40/324
8,291,629 B2 * 10/2012 Silverstein ..... G09F 7/06 40/606.01
8,430,253 B1 * 4/2013 Jackson ..... A47B 97/00 211/106
D692,498 S * 10/2013 Valls ..... D20/43
9,113,773 B2 * 8/2015 Bartloff ..... A47B 95/043
9,277,819 B1 * 3/2016 Pirkl ..... A47B 96/025
9,782,891 B2 * 10/2017 Blake ..... B25H 3/06
2006/0102084 A1 * 5/2006 Garfield ..... A01K 1/0107 119/165
2008/0251688 A1 * 10/2008 Rajusth ..... A21B 3/131 249/166

* cited by examiner

SYSTEM FOR OPTIMIZING USE OF STORAGE SPACE

BACKGROUND

This invention relates generally to a system for providing added space in cabinet pull-out sliding drawers or shelves. More specifically, the system allows individuals to store additional items or material within the same space, while also providing the support needed to prevent items/material from falling out.

In many households, the amount of area available to store items/material in pull-out sliding drawers has far greater potential than what is actually used, or perceived to be allowed. Both new and pre-existing pull-out sliding drawers provide a certain area in which to store items/materials, which is defined by the area of the drawer bottom surface, and the height of the walls/dividers typically positioned on the sides. These manufactured drawers may also define what items/materials can be stored in a pull-out sliding drawer based on the dimensions. As is well known, pull-out cabinet sliding drawers or shelves can be constructed with various wall/divider configurations and dimensions (e.g. thickness and height). Often times, the walls are somewhat short or non-existent, theoretically leaving additional free space available within the cabinet to store items/material. Stated differently, the walls are intentionally designed to be low, to leave additional space or area to stack items, and so the cabinet does not feel overly clustered or full. Many times however the height of these "wall/dividers" is too low to store additional items/materials, and too low to prevent additional items from easily falling over the drawer edges. As a result, the total "potential storage area" provided is not being effectively or efficiently utilized. Ideally, the total "potential storage area" would be usable, including the space above the walls/dividers in a pull-out sliding drawer and/or on top of the items/materials currently stored in the sliding pull-out drawer, and extending to the bottom of the pull-out sliding drawer or the bottom of the top of the overall cabinet above.

In addition to the issues outlined above, homeowners often get very frustrated when items/materials fall over the edges of existing pull-out drawers or shelves. When this happens, items must be retrieved from tight and often awkward spaces. After this has happened a few times, the user will avoid any attempts to stack items, or make use of total available space within the cabinet.

SUMMARY

The system described below provides the ability to add height and support to an outer portion of pull-out sliding drawers or shelves, thus providing more usable storage space. More specifically, a shelf extender is attachable to the walls or dividers of a pull-out sliding drawer, thus allowing a user to optimize the use of space available. The shelf extenders can be easily attached to any desired portion of the pull-out drawers (i.e. the back, sides, front, internal dividers, etc.) to create a more effective storage system. Further, the shelf extender is removable and thus can be easily repositioned as needed. By providing the additional height and support to these sections, more space is being utilized to store items/materials in the area provided.

The shelf extender of the various embodiments easily attaches to any wall/divider of a pull-out sliding drawer, including side wall, back wall, front wall and/or middle wall (divider). When added to the top of one or more of the four sides and/or middle (divider) "walls" of a pull-out sliding drawer, our shelf extender provides support to help contain and hold additional items/materials. As a result, this shelf extender allows one to better utilize the "potential storage area" provided and at the same time prevents items/materials from falling out. The shelf extender is removably attached to the walls/divider, thus repositioning or reconfiguration can easily be accomplished by a homeowner. With the flexibility and ease of use, the shelf extender can be used on one wall or divider or multiple sides, as well as, it can be quickly put on or taken off when and where additional space and support is desired.

As will be recognized, items/material may include, but is not limited to, any physical item or substance: anything that can be stored in a drawer/shelf/storage space area or wherever this product is used—groceries, personal household items, utensils, paper products, towels, spices, glasses, pans, Tupperware, lids, covers, etc.

The general purpose and objective of the invention is to create additional storage space in an existing pull-out sliding drawer and provide support for the current and added items/materials stored preventing them from falling out. In the description below, additional storage area is also called "potential storage area".

The benefits of the various embodiments of the shelf extender include effectively and efficiently utilizing the "Potential Storage Area" by creating more space to contain and store more items/materials than one would expect. By using sturdy material and a robust attachment system, the resulting structure's strong enough to hold added items/materials and to prevent it from falling out. As further discussed below, the shelf extender can be placed on pull-out sliding drawer wall or divider with the upward extending side panel or upright wall on the inside or outside of the wall or divider, with either adding more support (tightness) of the stored material or adding additional space to store.

To provide additional flexibility, the shelf extender is easily attached and/or removed, thus making its flexible enough to use only when and where needed. The shelf extender is not permanently attached but rather can be place on and taken off within seconds, thus also allowing reconfiguration. Naturally, the shelf extender, can be placed in different locations within the pull-out sliding drawer where it is needed. This allows users to address particular concerns or problem areas. In some cases, a clear material is used, thus allowing users to see what is in the storage area.

The clamp or attachment structure is typically positioned at an angle and includes a desired level of flexibility, thus allowing use of the shelf extender on different size walls/dividers while containing to proper support to hold it in place. In some embodiments, the structure of the clamp is configured with one side (arm) longer than the other to increase the ease of attaching the shelf extender.

Additional features can be provided by certain uses and configurations for the shelf extender. For example, where an additional side panel or wall is added on the other side of panel base, and clamped in place additional storage space is provided to hold and store small packages. Such space could also be extended down into the drawer base to store larger items, such as tupperware covers, utensils, straws, food packets, etc. In addition, the product is designed so it could be placed on an inside edge of the drawer walls/dividers, as the drawer rollers may prevent the product from being placed on top of walls.

BRIEF DESCRIPTION OF THE DRAWINGS

Further objects and advantages of the preferred embodiments will be apparent from reading the following detailed description, in conjunction with the drawings, in which.

DESCRIPTION OF THE PREFERRED EMBODIMENTS

Various embodiments of the shelf extender, and related systems, are discussed below. It will be understood that the shelf extender is available in different dimensions (height, length, shape, configuration, etc.), as well as, in different colors to meet the needs of the user. As will be seen, the dimensions of this shelf extender are often dependent upon the size of the pull-out sliding drawer and the "potential storage area" available.

Material used to construct the preferred embodiment of the shelf extender will be plastic. This plastic will provide flexibility, durability, and strength to support items/materials that will be stored in a pull-out sliding drawer. This shelf extender will also be constructed at different lengths and heights, all dependent on the length and width of the pull-out sliding drawer and the height of the "Potential Storage Area." That said, the shelf extender can be of various shapes and configurations to accommodate the dimensions and shape of the cabinet pull-out sliding drawer (e.g. square, rectangle, curved, etc.) and to meet the wishes of customers.

Figure 1:
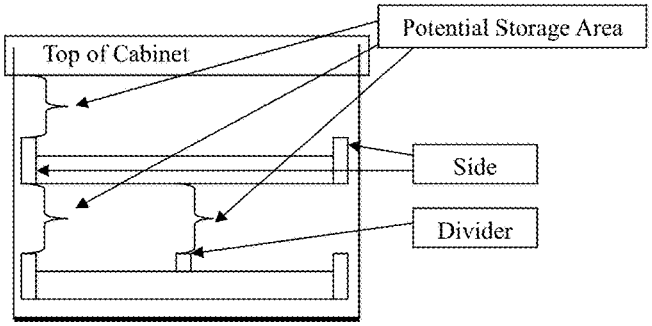
FIG. 1 shows the front view of a cabinet with two pull-out sliding drawers and desired placement of the shelf extender.
Figure 2:
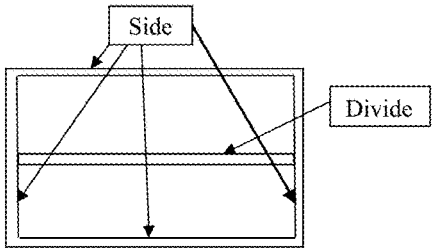
FIG. 2: top view of a pull-out sliding drawer showing all the potential walls, including front, back, side, and middle/divider walls.

As shown in FIGS. 1 & 2 the placement within a cabinet can vary. In this example two pull-out drawers are shown. The arrows point to an example of a pull-out sliding drawer "wall", where the shelf extender would be attached to. This figure shows two side walls and one middle/dividing wall. This figure also defines the "potential storage area." The "potential storage area" includes from the top of the walls, and/or top of the items/materials currently stored in the drawer to the bottom of the top of cabinet or drawer above. FIG. 2 shows a top view of an exemplary drawer, showing the sides and a divider. As further discussed below, each of these structures can support a shelf extender.

In various figures below, both the front and back view of the shelf extender will look similar, with the exception that either the front or the back portion of the clamp will be longer to increase the ease of placing on a wall or divider and provide additional support. The dotted lines in the clamp represent the longer portion of the clamp. In addition, the side panel or upright wall will be placed on one side of the flat panel base. Also, ribs may be placed in the upright wall for additional strength, as noted by the lines in the upright wall.

In order to attach the shelf extender to the (walls/divider) of the pull-out sliding drawer, a clamp mechanism will be used. This clamp mechanism is generally a "U" shaped structure, configured to fit over the wall/divider of the pull-out sliding drawer. Depending on the size of the shelf extender, there will be a minimum of one clamp per shelf extender, with multiple clamps being used where the size of the shelf extender requires additional support. The "Upright walls" of the shelf extender—(see e.g. FIG. 4) is attached to the outer sides of the clamp mechanism and top of the flat panel base, which allows the (shelf extender's) upright wall to be placed on either the inside of the wall of the pull-out sliding drawer or turned around and placed on the outside of the wall of the pull-out sliding drawer. When the shelf extender is placed on the inside part of the wall/divider, not only does it provide additional storage space, it provide additional support for items stacked right up to the wall/divider. If the shelf extender is placed on the outside part of the wall/divider, it provides additional space for various items. The versatility of having the shelf extender placed on the outside or inside of the wall/divider is a unique part of our shelf extender.

Because the walls/dividers of pull-out sliding drawers can be at different thicknesses, the clamp is constructed to be flexible to accommodate various width wall/divider. One side of the clamp is inward positioned to create additional support and tightness. This flexibility of the clamp enables our shelf extender to be secure. In addition, one side of the clamp will be longer than the other side, making it easier to put the shelf extender into place by pressing the longer portion of the clamp against the pull-out sliding drawer wall or divider.

The shelf extender will be available in different colors, including being clear. Having a clear material will add additional value of the shelf extender because now the owner of the shelf extender can look through the shelf extender to see what is stored on the pull-out sliding drawer.

Figure 3:
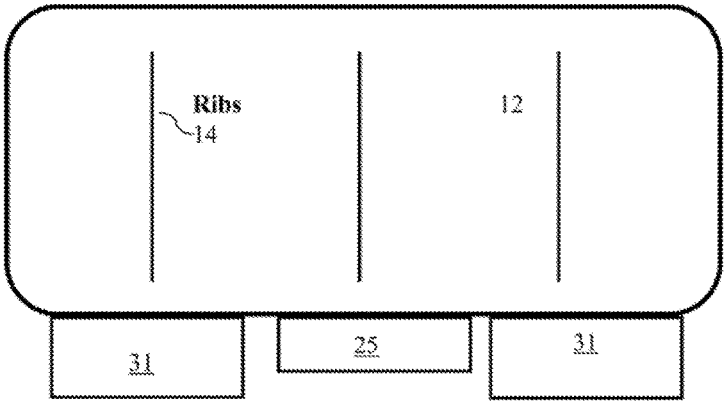
FIG. 3 is a back view of the shelf extender.
Figure 4:
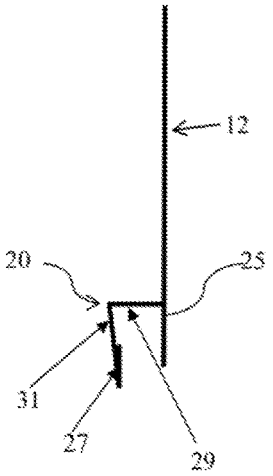
FIG. 4 is side view of the shelf extender and clamp, depicting how the upright wall of the shelf extender is on the very edge/top of the "clamp" and one side of the flat panel base.

Referring again to FIGS. 3-4, a more detailed illustration of one embodiment of the shelf extender 10 is shown. More specifically, FIG. 3 shows a back view of shelf extender 10. As can be seen, shelf extender 10 includes an upright portion or upright wall 12 which will provide containment and support when in use. In a similar manner, FIG. 4 illustrates a side view. In this particular embodiment, shelf extender 10 is approximately 8 inches wide and 6 inches high. That said, it will be clearly understood that variations in size and configuration are easily possible and in some cases necessary. As discussed herein, the terms "front" and "back" are utilized to provide spatial references, however the orientation and positioning could easily vary.

Figure 5:
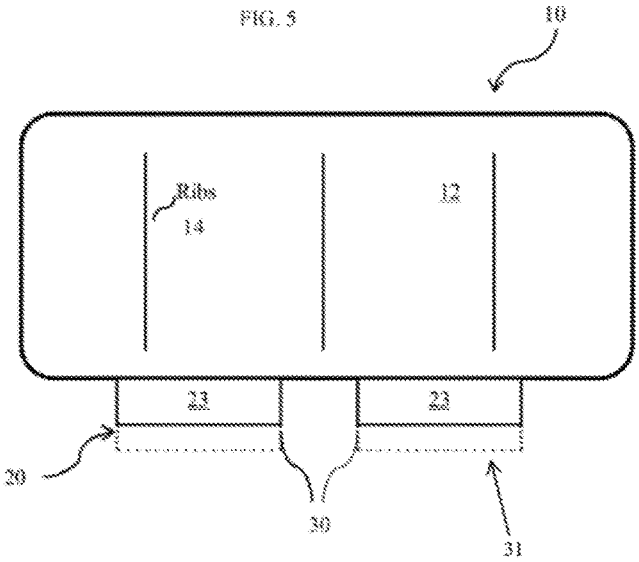
FIG. 5 is a front view of another embodiment of the shelf extender.
Figure 6:
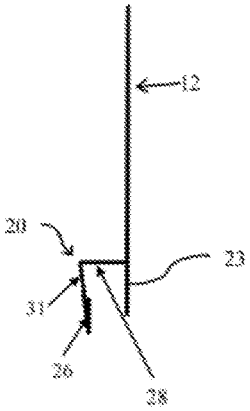
FIG. 6 is a side view of the shelf extender.

As illustrated in FIGS. 5-6, shelf extender 10 includes a clamp or connection structure 20 for use in connecting to shelf structures. In one embodiment, illustrated in FIG. 5, clamp structure 20 includes a first pair of connection mechanisms 23. As better illustrated in FIG. 6, which is a side view, connection mechanisms 23 each include a flat panel base 28, which extends substantially perpendicularly from the upright wall 12, and a clamping tab 30 which extends downwardly from the flat panel base 28. As can be seen, clamping tab 30 extends at a slight angle inwardly so that a bottom portion of clamping tab 30 is closer to an upright wall extension 23 then the upper portion. In this particular embodiment, shelf extender 10 is configured of a plastic material which is somewhat flexible. Using this type of material first clamping structures 23 are thus devised so that a bottom portion of clamping tab 30 will flex outward during attachment, and then maintain compression to hold upright wall 12 in a substantially vertical or substantially upright orientation.

As will be appreciated, FIG. 3 illustrates a similar configuration however connection mechanism 20 is slightly modified. Referring to FIGS. 3 and 4, it can be seen that a downward extending portion 25 of upright 12 extends in the same plane at a bottom portion thereof. A flat panel base 29 extends outwardly in a substantially perpendicular manner while a clamping tab 31 extends downwardly and inwardly therefrom. Again, the flexible nature of the materials used, and the configuration of clamping tab 31, allows movement, and provides a clamping pressure when sandwiched around a portion of the shelves. As illustrated in both FIGS. 4 and 6, a rubber surface or pad 26, 27 could be provided to an end portion of clamps 30 or 31 to help perform a gripping function.

It should be noted that the upright portion 12 in both FIGS. 3 and 5 is illustrated to have supporting ribs 14 to provide rigidity and strength as desired. Those skilled in the art will recognize that several variations are possible and the ribs may or may not be necessary.

Figure 7:
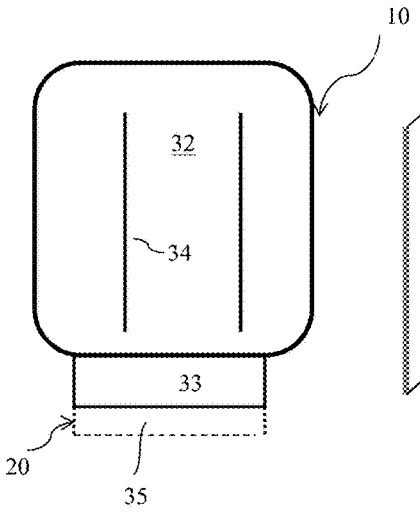
FIG. 7 shows a front view of a small version of the shelf extender.
Figure 8:
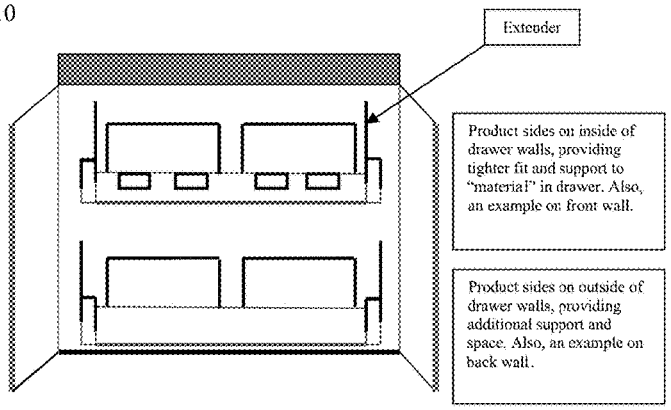
FIG. 8 illustrates an example of the shelf extender inserted on to side walls of pull-out sliding drawers and either the back or front wall, with one example showing the side of the shelf extender on the inside of the drawer wall, and another example showing the side of the shelf extender on the outside of the drawer wall.

Referring now to FIG. 7, a smaller version of the shelf extender 10 is illustrated. Again, an upright portion 32 is provided, which may or may not have ribs 34 a similar connection mechanism 20 is utilized, however this embodiment simply includes a single downwardly extending portion 33 and a clamping tab 35.

Figure 16:
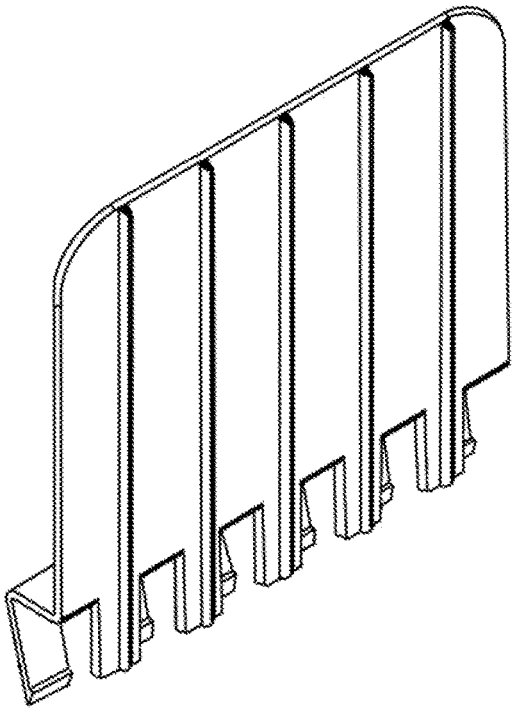
FIG. 16 rear perspective view of the embodiment shown in FIG. 11.
Figure 18:
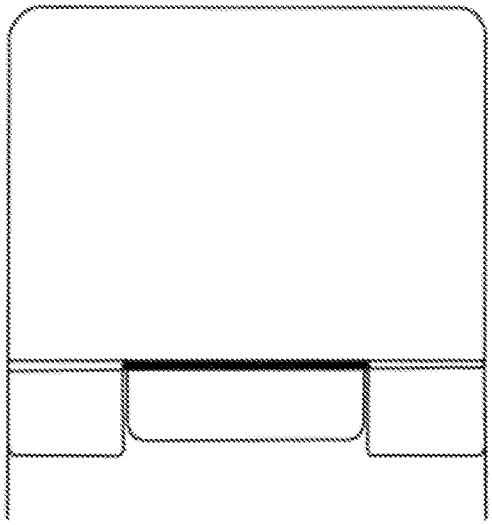
FIG. 18 is a front view of the embodiment shown in FIG. 17.
Figure 19:
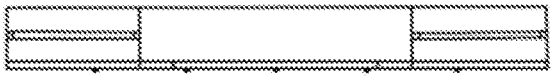
FIG. 19 is a bottom view of the embodiment shown in FIG. 17.
Figure 20:
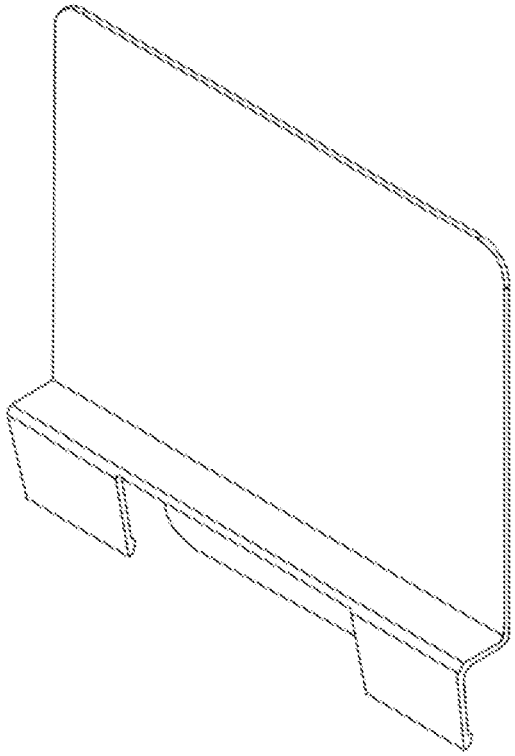
FIG. 20 is a front perspective view of the embodiment shown in FIG. 17.
Figure 21:
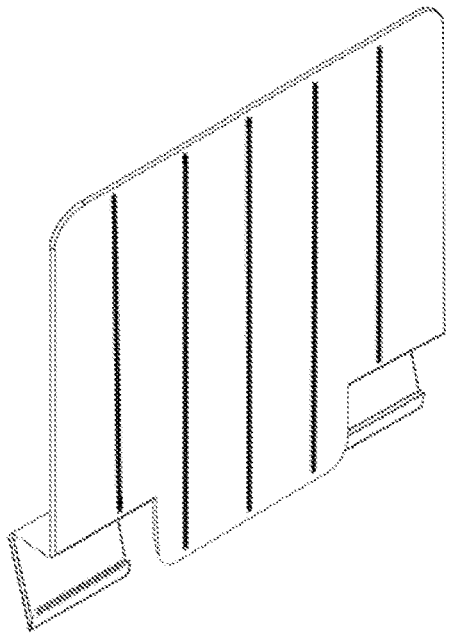
FIG. 21 is a rear perspective view of the embodiment shown in FIG. 17.
Figure 22:
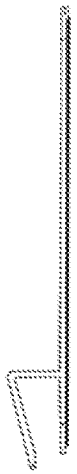
FIG. 22 is a side view of the embodiment shown in FIG. 17.
Figure 23B:
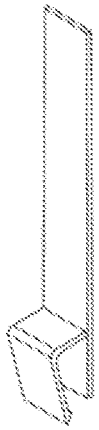
FIGS. 23A and 23B are side and perspective views respectively of yet another embodiment of the shelf extender.
Figure 23A:
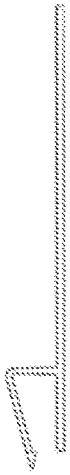

In a similar manner, FIGS. 11-17 illustrate an alternative embodiment, where the connection mechanism 20 is made up of several alternating teeth or tabs 50. In this particular embodiment, upright wall 40 again is substantially minor and configured to extend in an upright manner when attached. Again a flat panel base 48 extends in a substantially perpendicular manner away from upright 40. A plurality of downwardly extending portions 43 extend in the same plane as upright 40, however extending downwardly from the location where flat panel base extends. Here, a plurality of clamping tabs 50 then extend downwardly from a portion of flat panel base 48, again at an inwardly directed angle. As illustrated in FIG. 16, a clamping or holding structure is again created, where clamping tabs 50 provide a compression force, against any material positioned between extension 43 and clamping tab 50.

Yet another embodiment of the shelf extender is illustrated in FIGS. 18-21. This embodiment is very similar to the previously discussed embodiments, however a slightly revised connection mechanism is used.

As shown above, the shelf extender system will assist in a) creating and providing additional space to store additional items/material in the pull-out sliding drawer than one would expect; at the same time b) provide support that would prevent Material from falling out of the pull-out sliding drawer. Generally speaking, the shelf extender includes upright walls that can be at various heights, lengths, and shapes depending on the size of the pull-out sliding drawer (i.e. the potential storage area provided). The shapes may also be varied, including but not limited to square, rectangle, triangle, circle, etc. and may change to accommodate market demand; being located on either side of the flat panel base of the clamp (see FIGS. 4 & 6), allowing the device to be placed on pull-out sliding drawer with upright wall either on the inside of the side wall or divider or the outside of the side wall. Alternatively, the extender could be placed on a central divider, providing multiple functional uses. Having the extender placed on the wall or divider so the shelf extender upright wall is located on the inside of the wall/divider, it provides additional "tightness" support right up against the items/materials stored. Having the shelf extender placed on the wall or divider so the shelf extender upright wall is located on the outside of the wall/divider, it creates and provides additional space of storage.

As shown above, ribs may be included on the upright walls to provide additional strength and support. Alternative strengthening structures could also be included.

As also discussed above, clamps enable the shelf extender to be securely placed on and removed from the wall or divider of the pull-out sliding drawer in an instant, but secure enough to provide the proper strength and support necessary. Generally speaking, the clamps will consists of two sides facing one another which provide a clamping force to hold the shelf extender in place. In one embodiment the clamp one side of the clamps will be pointed at an angle to ensure clamp is touching enough of the drawer wall or divider. In some embodiments, this angle may be between 0° to 10° (degrees), which helps provide additional support when placed on to a pull-out sliding drawer wall or divider. Naturally, these skilled in the art will recognize that these angles can be greatly varied, depending on the type of materials used or the particular proportions involved. One additional feature involves one of the two sides being longer than the other, which assists with placing the said device to the pull-out sliding drawer wall or divider. When this longer piece of one of the clamp sides is pressed against the wall or divider of the pull-out sliding drawer, it opens the clamp wider, increasing the ease of attaching (placing) the said device.

In another example, front and back alternating positions are used. For example, the front and back clamp arms alternate on the both sides of the flat base. When there is a clamp on the edge, the back clamp arm will be moved over with the next clamp arm in the front. The alternating positions may provide constant support. A lip on tip of clamp adding additional support when attached to pull-out drawer wall.

As indicated, the flat base located at the top of the clamp(s) and the bottom of the side of the upright panels are attached to flat base. The flat base will be wide enough to fit on the wall and/or divider of a pull-out sliding drawer. The wall or divider has various widths, typically running from ¼ inch to ¾ inch—based on current study. The shelf extender may be used for any size or dimension as needed to provide additional storage space for various items/material.

As mentioned above, the shelf extender is flexible enough to be put on and/or taken off when needed and/or placed in various sections of walls/dividers as desired. This allows for repositioning as needed, and for significant flexibility.

As also discussed above, the shelf extender will be manufactured in various sizes and shapes to accommodate different size pull-out cabinet drawers. The shelf extender clamp will tightly secure to the walls/dividers in order to provide proper support for storing additional items/materials. The shelf extender will be multiple colors to match cabinetry, including having it clear. Having a clear shelf extender will enable the user to see what is being stored.

There is also the option to place wording to the surface/side of shelf extender. This would define what is stored in the drawer. An example would be "soup", "snacks", etc. This wording could be permanent or also a peel away material which could be placed on shelf extender.

As an additional enhancement, the shelf extender will be further configured to add an additional storage feature based on an additional upright wall placed on the opposite side of flat base (where the current panel base is) and each of the two ends, acting as a cap, to enclose the storage area. This version of the shelf extender will enable one to store additional Material inside the panels and on top of flat base. As an example FIG. 10 shows a side view of the enhanced shelf extender, having a "J" type configuration, with additional storage capabilities.

Figure 10:
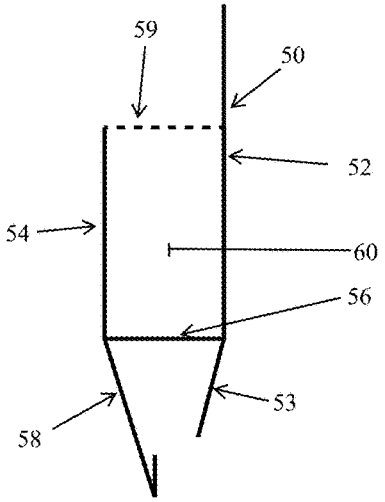
FIG. 10 shows a side view of an alternative embodiment where additional storage space is provided.

Referring now more specifically to FIG. 10, the shelf extender 50 will be further configured to add an additional storage feature based on an additional or secondary upright wall (side panel) 54 placed on the opposite side of the flat panel base 56 (parallel to upright wall 52). In addition, a panel 59 is attached on each of the ends of the flat panel 56, acting as a cap. This new configuration encloses the storage area 60. While still providing additional height and support to store more items/material in a pull-out sliding drawer (thus better utilizing storage space available and preventing items/material from falling out) this configuration provides an additional storage compartment 60 where the user can store small packages and/or small individual items (e.g. water flavoring packets, gravy packages, micro-wave popcorn packages, etc.). The added upright wall 54 may also be placed at the base of the current clamps and extended outward from the pull-out sliding drawer and into the enclosed drawer area, providing a much larger compartment for storing larger items like Tupperware covers and pots/pan covers. This embodiment also shows extension 53 positioned at an angle with respect to upright wall 52. In certain applications, this may provide additional holding force and enhance the operation of the connection mechanism.

By providing additional height and support to store more items/material in a pull-out sliding drawer and better utilizing storage space available and preventing items/material from falling out, an additional variation of the embodiment will allow shelf extender to be expandable, either expanding in its length (small/longer) or expanding in its height, up and down. This configuration uses the same original configuration but provides the ability to expand the shelf extend to a desired length. An example would include a shelf extender currently at 8 inches expanded on a slider to now a 16 inch shelf extender. In a similar fashion, this same concept may be used vertically, as well.

An additional variation of the embodiment will allow the shelf extender to be designed for drawers which prevent the placement of the shelf extender product on the top of a pull-out sliding drawer wall/divider due to the configuration of the pull-out sliding drawer and its cabinet drawer slides. This variation allows the shelf extender to expand, as well as, be placed along side the inside and up against a pull-out sliding drawer wall/divider. With the ability to slide or extend to get larger or smaller or designed to be the exact size of the drawer, this version of the shelf extender is attached by either expanding larger or smaller so the end caps are placed up against the adjourning pull-out sliding drawer wall that is perpendicular to the wall/divider it is intended to be placed on. Attachment would be accomplished by end caps similar to suction cups.

In addition to the details discussed, an additional embodiment will allow the extender to be expandable. In this example, when placed on a wall, the extender can slide to get larger or smaller. In this embodiment, the extender in one configuration would be 8" long. A "slider" could be included in which you could pull the product so it is now 16" long. This may be a similar concept for a vertical approach as well. One can increase the height or decrease the height.

Example 1: Product Used with a Pull-Out Sliding Drawer

Figure 9:
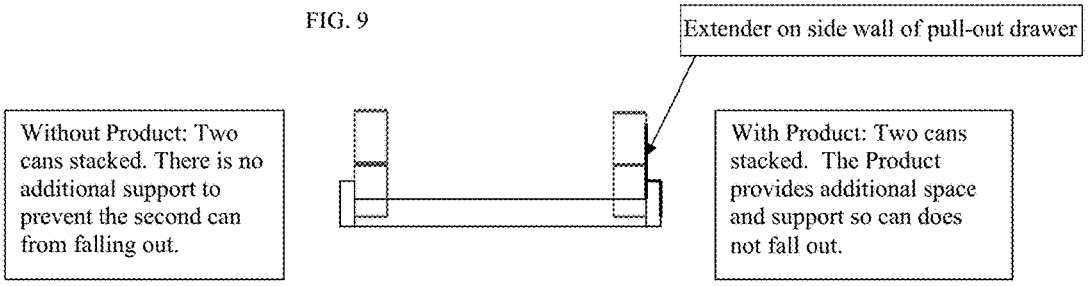
FIG. 9 provides an illustration of storage options with and without the shelf extender.
Figure 11:
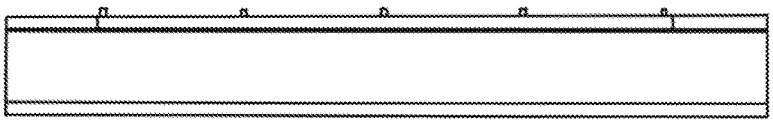
FIG. 11 is a top view of an embodiment of the shelf extender.
Figure 12:
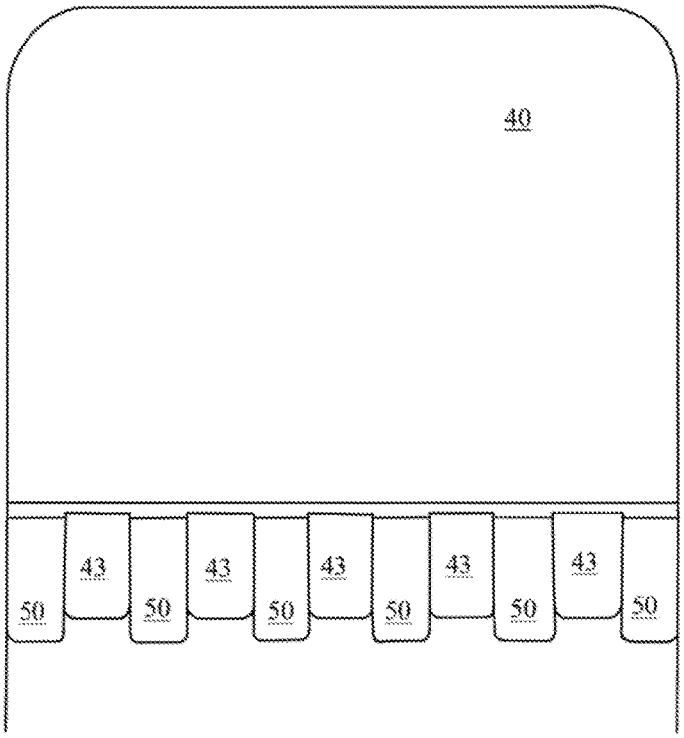
FIG. 12 is a front view of the embodiment shown in FIG. 11.
Figure 13:
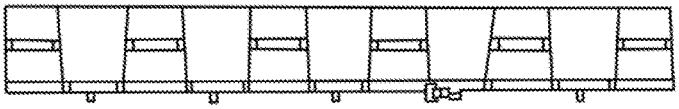
FIG. 13 is a bottom view of the embodiment shown in FIG. 11.
Figure 14:
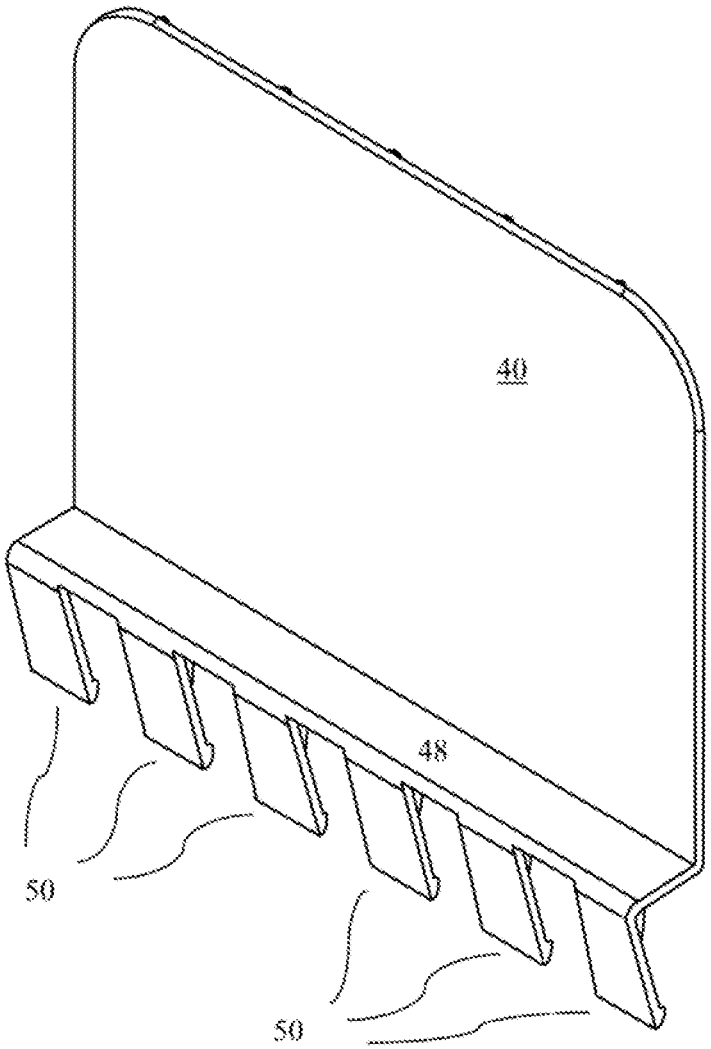
FIG. 14 is a front perspective view of the embodiment shown in FIG. 11.
Figure 17:
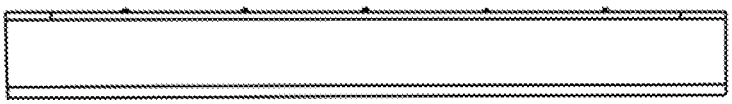
FIG. 17 is a top view of another embodiment of the shelf extender.
Figure 15:
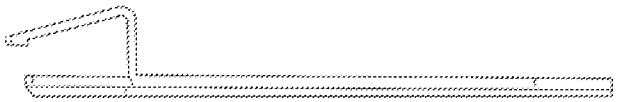
FIG. 15 side view of the embodiment shown in FIG. 11.

As one example, best illustrated in FIG. 9 stack two cans of soup (approximately 4" in height) on top of one another inside a pull-out sliding drawer with low side walls. In this example, the pull-out sliding drawer of a cabinet has a 1⅝" wall height (inner side portion of the front, back, side, outside wall and/or an inside divider wall) and it can support one can of soup where the can will not fall over or outside the drawer. The space above the drawer wall and or can of soup ("potential storage area") may allow an additional can of soup to be stacked on top of the first can of soup that is already placed in the drawer. However, because the side wall (in this case) is only 1⅝" high, the first can of soup will stay in the drawer while the second can of soup will easily fall over the outer side drawer wall or an internal divider wall (with movement by the drawer or the drawer or material being bumped, etc.) because it will have no support to keep it in the drawer. Our invention provides the additional height and support to allow the second can of soup to be stacked on top of the first can of soup (without it falling out), therefore, adding additional space to store items/materials. This same concept can be used for any type of items/materials placed in this pull-out sliding drawer.

In this example above, we are referring to a 24" cabinet with pull-out sliding drawers having drawer dimensions of 19" by 21" from the outside of each end of the drawer. Please note that the shelf extender is intended and can be used with any size (dimension) drawer. The side "walls" in this example are ¾ of an inch wide (thick) and the walls are 1⅝" high from the bottom of the wall inside the drawer to the top of the wall. In this case, there is no middle divider wall. That leaves the storage space inside the walls at 17.50 inches by 19.50 inches, taking into account the combined width or thickness of the side walls (1½ inches based on 2×¾ inches). The height from the bottom of the drawer (inside the walls) to the top of the inside of the cabinet is 9", providing a total storage space area of 3,071 square inches. By adding the can of soup, if the entire pull-out sliding drawer (bottom)

was filled with 1 can of soup (which is 4" high), the total area used would be 1,365 square inches (4"×17.50"×19.50"). There would be 1,706 square inches of area still remaining ("potential storage area") that is not being utilized, calculated by 3,071 sq inches minus 1,365 sq inches. If we decreased the 9" height of storage area by ¼", to allow for the drawer to open and close without items/materials hitting the opening of the top of the cabinet or drawer above, the total storage space is 2,985, with the ADDITION STORAGE AREA of 1,620 square inches (4.75"×17.50"×19.50") available after storing the can of soups. This is more than the area used by the 1 can of soup stored on the bottom of the entire drawer. In this example of a 24 inch cabinet and 19"×21" pull-out sliding drawers using our shelf extender helps utilize the additional 1,620 square inches of area remaining and at the same time not have material fall out. Additional space various by size of drawer.

Although the examples and embodiments mentioned above show attachment to the sides and divider of a pull out drawer, it will be recognized that further variations are possible. For example, the shelf extender could be configured to work in conjunction with a "Lazy Susan" type shelf or cabinet, a rotating turn table, or any other storage structure which is configured to hold products and is has issues with "containment" of items or materials.

Various embodiments of the invention have been described above for purposes of illustrating the details thereof and to enable one of ordinary skill in the art to make and use the invention. The details and features of the disclosed embodiment[s] are not intended to be limiting, as many variations and modifications will be readily apparent to those of skill in the art. Accordingly, the scope of the present disclosure is intended to be interpreted broadly and to include all variations and modifications coming within the scope and spirit of the appended claims and their legal equivalents.

What is claimed is:

1. A removable shelf extender for creating usable space within a storage cabinet having a pull-out sliding drawer with sidewalls, the removable shelf extender comprising:

a continuous upright wall member having an upright wall portion and a connection portion that can be quickly and easily attached to the sidewall of the pull-out sliding drawer, thus providing lateral support to assist in for containing items within a space above an upper edge of the sidewalls of the pull-out sliding drawer;

wherein the upright wall portion provides a rigid upright containment surface extending upwardly and beyond the existing edge of the sidewall of the pull-out sliding drawer, the continuous upright wall member also extending along a length of the sidewall of the pull-out drawer thus providing the ability to contain product positioned within the space above the surface of the pull-out sliding drawer; and an integral connection structure comprising a lateral extension protruding from an intermediate location on the upright wall member so that the upright wall portion of the continuous upright wall member extends above an upper surface of the lateral extension and the connection portion extends below the lateral extension, the lateral extension having a bridge portion extending substantially perpendicular to the continuous upright wall member and configured to rest upon an upper edge of the pull out drawer, and a holding portion extending in a downward direction from an end of the bridge portion, with the continuous upright wall member the integral connection structure being a single piece;

wherein the connection structure is flexible, thus allowing a bottom edge of the holding portion to be movable with respect to a lower edge of the upright wall portion, that the connection structure further configured to produce a compression force when the bottom edge is moved away from the lower edge of the upright wall portion, wherein the compression force is able to hold the upright wall member in position when attached to the pull-out sliding drawer, and wherein the connection structure is sized such that, when connected to the pull-out sliding drawer, the connection structure will not interfere with or contact the cabinet when the pull-out sliding drawer is slid out of the cabinet; and wherein the holding portion has a length sized so that the bottom edge of the holding portion of the connection structure is not aligned with a bottom edge of the upright wall, thus making movement of the connecting structure more convenient, and such that the lateral extension will be located adjacent an upper edge of the sidewall.

2. The removable shelf extender of claim 1 wherein the height of the upright wall portion extends to a position just below an upper boundary of a potential storage area available above the pull-out sliding drawer, wherein the potential storage area extends from the top surface of the pull-out drawer to a bottom portion of a second pull-out sliding drawer or a cabinet upper wall positioned thereabove.

3. The removable shelf extender of claim 1 wherein the upright wall portion has at least one strengthening rib.

4. An upward extension removably attachable to an upwardly extending edge portion of a pull-out sliding drawer to provide more effective storage space upon and above a surface of the pull-out sliding drawer, comprising:

a continuous and rigid upright wall having a wall surface substantially greater than the edge portion of the pull-out sliding drawer;

a connection structure integral with and extending from the continuous upright wall, the connection structure having a transition portion extending away from the continuous upright wall at an intermediate location along the upright wall, and a holding portion oriented in a position extending downward from the transition portion, wherein a lower portion of the continuous upright wall, the transition portion and the holding portion generally form a U shape which is sized and configured to surround and rest upon the edge portion of the pull out drawer and wherein an upper portion of the upright wall extends above the transition portion thus creating a containment surface; and a second upright wall integral with and extending upwardly from the transition portion and substantially parallel to the upright wall, wherein the upright wall, the second upright wall and the transition portion create a storage space having an opening accessible from above an upper edge of the continuous upright wall and the second upright wall;

wherein the continuous and rigid upright wall, the connection structure and the second upright walls are all integral with one another and form a single piece wherein the connection structure has a predetermined amount of flexibility so that a bottom section of the holding portion can be pulled outwardly away from the bottom portion of the upright wall thus creating a compression force there between is when attached to the upwardly extending edge portion of the pull-out sliding drawers and wherein the compression force is capable of holding the upright wall in position in a manner to provide lateral support thus helping to contain items within the storage space upon and above the surface of the pull-out sliding drawer.

5. The upward extension of claim 4 wherein the upright wall is sized to extend substantially the entire length of the edge portion of the pull out sliding drawer.

6. The upward extension of claim 4 wherein the upright wall and the second upright wall are substantially the same height above the transition portion.

7. The upward extension of claim 4 wherein the holding portion is non-continuous and comprises a plurality of tabs.

8. The upward extension of claim 7 wherein a bottom portion of the upright wall is non-continuous and comprises a plurality of tabs.

9. The upward extension of claim 4 wherein the upright wall has reinforcing ribs to provide rigidity.

10. The upward extension of claim 1 wherein the upright wall portion and connection structure are flexible along a lengthwise dimension thus allowing attachment to non-linear portions of the pull-out drawer.

11. The upward extension of claim 1 wherein the upright wall portion has a plurality of corners and the plurality of corners are rounded so as to prevent injury.

12. The upward extension of claim 1 wherein the upright wall portion is positioned along an inner surface of the sidewall.

13. A system for increasing the storage capacity of a pull-out sliding drawer, the system comprising:

a plurality of one-piece removably attachable extensions attachable to an upwardly extending edge portion of the pull-out sliding drawer, each of the plurality of attachable extensions comprising:

a continuous and rigid upright wall having a wall surface substantially greater than the edge portion of the pull-out sliding drawer;

a connection structure integral with and extending from the continuous and rigid upright wall, the connection structure having a transition portion extending away from an intermediate location on the upright wall, and a holding portion oriented in a position extending downward from the transition portion, wherein a lower portion of the upright wall, the transition portion and the holding portion generally forming a U shape which is sized and configured to surround and sit above the edge portion of the pull out drawer, and an upper portion of the upright wall extending upwardly from an upper surface of the transition portion thus creating a containment surface; and wherein the connection structure has a predetermined amount of flexibility so that a bottom section of the holding portion can be pulled away from the lower portion of the upright wall so that a compression force is produced when attached to the upwardly extending edge portion of the pull-out sliding drawers and the compression force is capable of holding the upright wall in position in a manner to provide lateral support thus helping to contain items within the storage space upon and above a surface of the pull-out sliding drawer.

14. The system of claim 13 wherein three extension are used and are attachable to two sides and a back edge of the pull-out sliding drawer, and wherein the two extensions attachable to the two sides extend substantially an entire length of the two sides, and the extension attachable to the back edge of the pull-out draw extends along a predetermined length of the back edge, thus providing containment walls on three sides of the pull-out drawer.

15. The system of claim 13 wherein each attachable extension has a bottom portion of the upright wall which is non-continuous and comprises a plurality of tabs, and each holding portion is non-continuous and comprises a plurality of tabs.

16. The system of claim 13 wherein at least one of the plurality of attachable extensions further comprises a second upright wall extending upwardly from the transition portion and substantially parallel to the upright wall, wherein the transition portion, the upright wall and the second upright wall create a storage space there between and above the transition portion which is accessible from above the upright wall and the second upright wall; and upright wall and the second upright wall being substantially the same height above the transition portion.

17. The system of claim 15 wherein the upright wall of each of the plurality of attachable extension further includes at least one reinforcing rib.

18. The system of claim 17 wherein the reinforcing rib extends onto a portion of the tabs located at the bottom portion of the upright wall.

* * * * *